US007967378B2

(12) United States Patent
Narboni-Campora

(10) Patent No.: US 7,967,378 B2
(45) Date of Patent: Jun. 28, 2011

(54) SLEEPING BAG WITH REMOVABLE STROLLER COVER

(75) Inventor: Chantal Celine Narboni-Campora, New York, NY (US)

(73) Assignee: 7 A.M. Enfant, New York, NY (US)

( * ) Notice: Subject to any disclaimer, the term of this patent is extended or adjusted under 35 U.S.C. 154(b) by 100 days.

(21) Appl. No.: 11/689,253

(22) Filed: Mar. 21, 2007

(65) Prior Publication Data

US 2008/0229499 A1 Sep. 25, 2008

(51) Int. Cl.
*A47C 31/00* (2006.01)

(52) U.S. Cl. ..... 297/219.12; 297/184.13

(58) Field of Classification Search ..... 297/219.12, 297/184.13, 229; 5/413 R, 494; 2/69.5
See application file for complete search history.

(56) References Cited

U.S. PATENT DOCUMENTS

| | | | | | |
|---|---|---|---|---|---|
| 2,677,834 | A * | 5/1954 | Moynihan | 128/872 |
| 3,227,484 | A * | 1/1966 | Merclean | 296/77.1 |
| 4,241,458 | A * | 12/1980 | Lesesne | 2/69.5 |
| 4,353,577 | A * | 10/1982 | Giordani | 280/642 |
| 4,753,483 | A * | 6/1988 | Beier | 297/465 |
| 4,846,528 | A * | 7/1989 | Beier | 297/465 |
| 4,892,353 | A * | 1/1990 | Goddard | 297/224 |
| 5,243,724 | A * | 9/1993 | Barnes | 5/482 |
| 5,437,061 | A * | 8/1995 | Kenner | 2/69 |
| 5,604,932 | A * | 2/1997 | Lawicki | 2/69.5 |
| 5,806,925 | A * | 9/1998 | Hanley | 297/229 |
| 5,956,766 | A * | 9/1999 | Benway | 2/69 |
| 6,012,189 | A * | 1/2000 | Dudley | 5/655 |
| 6,272,683 | B1 * | 8/2001 | Symms et al. | 2/69.5 |
| 6,311,330 | B1 * | 11/2001 | Rothman | 2/69 |
| 6,408,439 | B1 * | 6/2002 | Garforth-Crippen | 2/80 |
| 7,052,085 | B2 * | 5/2006 | Hoey-Slocombe et al. | 297/219.12 |
| 7,431,395 | B2 * | 10/2008 | Morgan et al. | 297/219.12 |
| 2003/0193221 | A1 * | 10/2003 | Hoey-Slocombe et al. | 297/184.13 |
| 2004/0217633 | A1 * | 11/2004 | Kassai et al. | 297/219.12 |
| 2005/0097671 | A1 * | 5/2005 | Wyman | 5/482 |
| 2005/0200174 | A1 * | 9/2005 | Morgan et al. | 297/219.12 |
| 2008/0222809 | A1 * | 9/2008 | Okell | 5/502 |

* cited by examiner

*Primary Examiner* — Sarah B McPartlin
(74) *Attorney, Agent, or Firm* — Volpe and Koenig, P.C.

(57) ABSTRACT

A sleeping bag includes a removable top blanket that converts into a single panel stroller cover. The removable blanket includes a fleece panel and drawstring forming a pouch that tucks under the edge of the stroller seat or footrest. The removable blanket further includes straps to attach the top to the side rails of the stroller.

20 Claims, 2 Drawing Sheets

SLEEPING BAG WITH REMOVABLE STROLLER COVER

FIELD OF INVENTION

The present invention relates to the field of children's sleeping bags and blankets for use in conjunction with seats for children.

BACKGROUND OF THE INVENTION

A sleeping bag is a large padded bag designed to be slept in. A bunting bag, similar to a sleeping bag, is a thick, warm garment for a baby that is shaped like a sleeping bag to cover the baby's body and legs, and usually includes a hood. Sleeping bags (or bunting bags) for use by children may have slits or openings in the back through which harnesses (such as from strollers and car seats) or seatbelts may pass through in order to allow safe use of the sleeping bag in child strollers, car seats and automobiles.

The sleeping bags disclosed in the prior art fit directly in the child's seat of the stroller, car seat or carrier. For example, U.S. Pat. No. 5,243,724 discloses a multipurpose baby wrap for use in conjunction with an infant seat. The multipurpose baby wrap has openings to receive each of the restraining straps of infant seat. U.S. Pat. No. 4,823,405 shows a baby safety bag for use in conjunction with an automobile baby seat or stroller, the bag having openings through the back portion spaced for seatbelts or harness straps of the baby seat or stroller. Similarly, U.S. Pat. Nos. 6,105,168 and 6,012,189 show a bunting bag shaped to fit within an infant seat, wherein the back portion of the bunting bag is contoured to the shape of the infant seat and also has a plurality of openings sized and located to receive the restraining straps of the infant seat.

In each case in the prior art, the whole of the sleeping bag or bunting bag is set within the car seat, stroller or carrier. Typically, the back portion of the sleeping bag tends to bunch up in the child's seat, or in any event reduces the amount of space available for the child to properly fit within the seat provided.

SUMMARY OF THE INVENTION

The present invention is embodied in a sleeping bag with a removable top piece that attaches to a child's seat (such as for example a child's seat in a stroller) and functions as blanket.

In particular, a child's sleeping bag in accordance with the present invention includes a removable top blanket that converts into a single panel stroller cover. The removable blanket includes fasteners at the side portions thereof for attachment to the side rails of the stroller. The removable blanket further includes means at the bottom portion thereof for fastening the bottom portion to or under the edge of the stroller seat or child's footrest. In one embodiment, the bottom portion of the removable blanket includes fleece panel and drawstring forming a pouch that tucks under the edge of the stroller seat or child's footrest.

DETAILED DESCRIPTION

Figure 1:
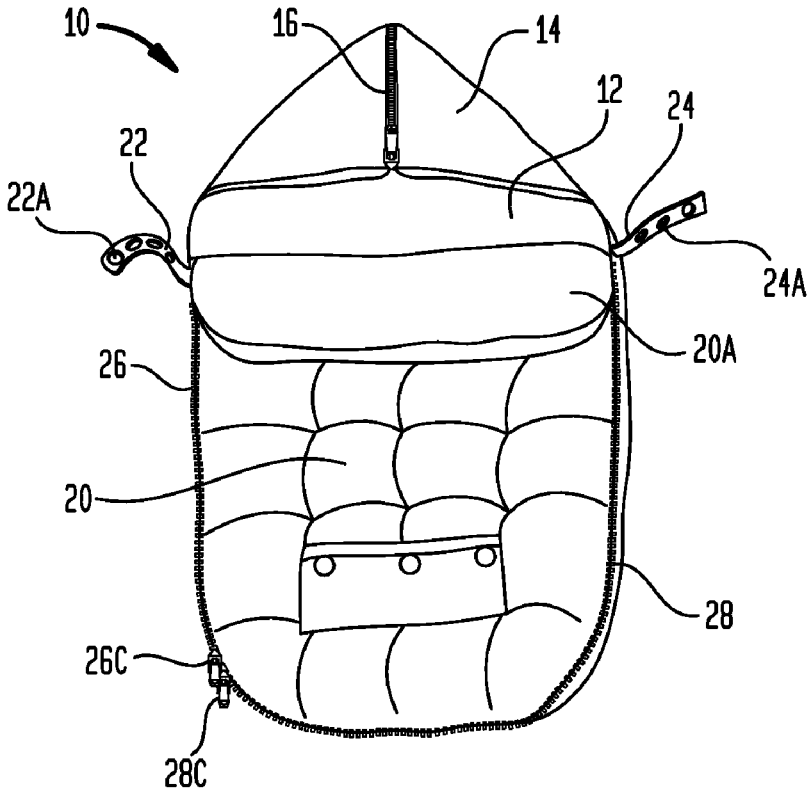
FIG. 1 is a front view of a sleeping bag with removable stroller cover in accordance with the present invention.

A child's sleeping bag 10 in FIG. 1 comprises a back portion 12 and a front portion 20. The front portion 20 attaches to the back portion 12 by a pair of zippers 26, 28 allowing a flap 20A to fold down exposing the child's face. A third zipper 16 joins two edges of the back portion to form a hood 14.

Figure 2:
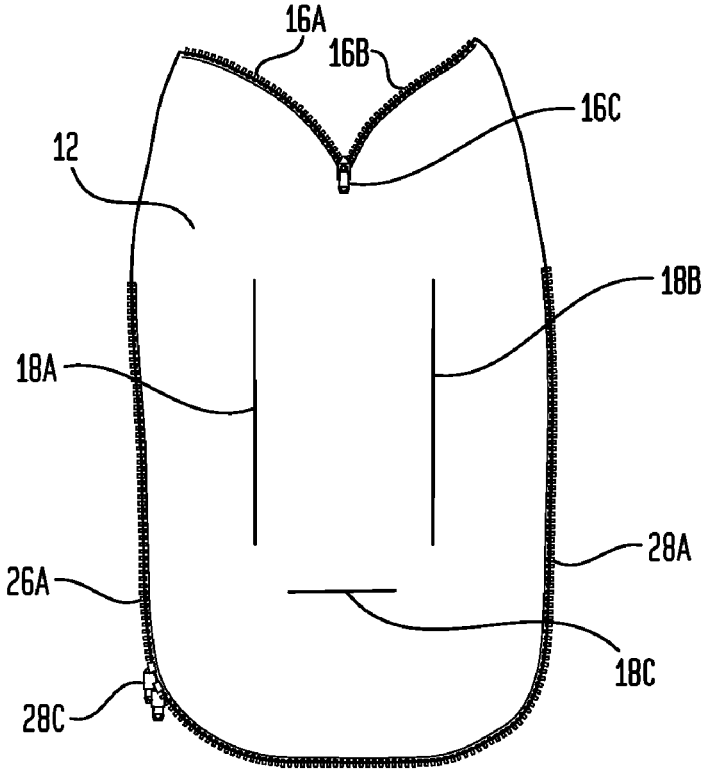
FIG. 2 is an interior view of the back portion of a sleeping bag with removable stroller cover in accordance with the present invention.

The back portion 12 of the sleeping bag 10 is shown in further detail in FIG. 2. First and second tapes of zipper teeth 16A, 16B, are attached to the top edges of the back portion 12. Slider 16C meshes the first tape of zipper teeth 16A to the second tape of zipper teeth 16B so as to form the hood portion 14. Openings 18A, 18B and 18C are provided in the back portion 12 to allow seat straps, harness and/or seat belts to pass through the back portion 12. A first tape of zipper teeth 26A is attached to one side of the back portion 12. A second tape of zipper teeth 28A is attached to the other side and continues around the bottom edge of the back portion 12.

Figure 3:
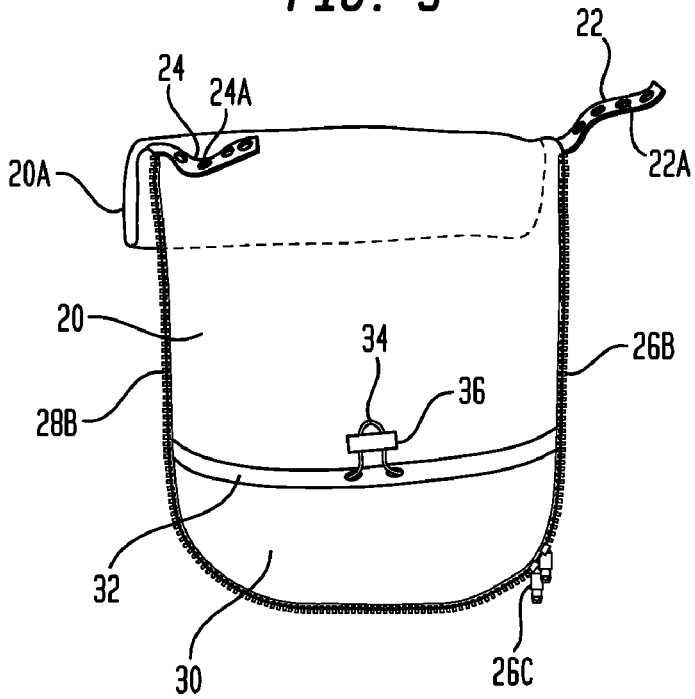
FIG. 3 is an interior view of the front portion of the sleeping bag with removable stroller cover in accordance with the present invention.

The front portion 20 of the sleeping bag 10 is shown in further detail in FIG. 3. A third tape of zipper teeth 26B and slider 26C is attached to one side of the front portion 20. A fourth tape of zipper teeth 28B and slider 38C is attached to the other side of the front portion 20. The tape of zipper teeth 28B continues around the bottom edge of the front portion 20. To join the front 20 and back portion 12 together, slider 26C meshes the first tape of zipper teeth 26A to the second tape of zipper teeth 26B, while slider 28C meshes the third tape of zipper teeth 28A to the fourth tape of zipper teeth 28B. The use of two zippers 26, 28 provides flexibility in opening the sleeping bag 10 to provide ventilation. Alternatively, one zipper with one or more two-way sliders could be used to join the sides and bottom of the front portion 20 to the back portion 12.

Figure 4:
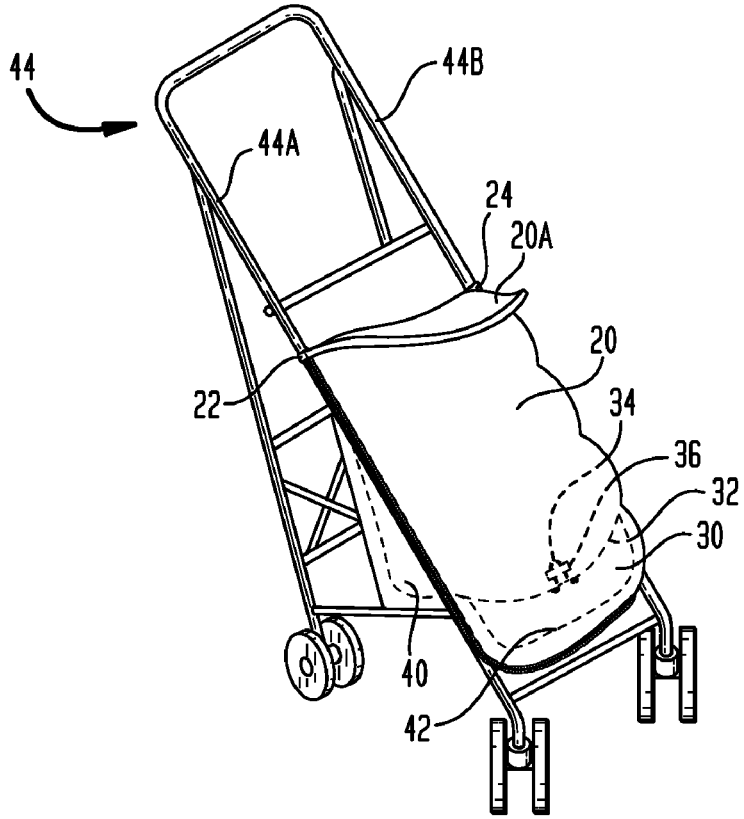
FIG. 4 is an isometric view of the top portion of the sleeping bag attached to a child's stroller as a single panel stroller covered in accordance with the present invention.

The front portion 20 also contains features to permit it to function as a removable stroller cover 20 (as shown in FIG. 4). In particular, the front portion 20 has a first strap 22 with snap fasteners 22A on one side, and a second strap 24 with snap fasteners 24A on the other side. At the interior bottom (foot region) of the front portion 20 is a fabric panel (which may be fleece fabric) sewn along the sides and bottom to the front portion to form a pouch 30 open at the top edge 32. The top edge 32 of the pouch 30 is folded over to form a fabric channel containing a drawstring 34 and locking mechanism.

For use as a removable stroller blanket, the top portion 20 of the sleeping bag 10 is removed from the bottom portion 12. Then, removable stroller blanket 20 is attached to a stroller as shown in FIG. 4. The lower portion of the stroller seat 40 and/or the footrest 42 is inserted into the pouch 30. The drawstring 34 is pulled tight and locked with locking mechanism 36 to hold the lower portion of the removable stroller blanket 20 to the stroller seat 40 and footrest 42 of the stroller 44.

The use of the pouch 30 tucked under the seat 40 or footrest 42 provides a good seal to the stroller and prevents cold air from entering the stroller seat 40 at the bottom edge of the removable blanket 20.

At the top, the removable blanket 20 is attached to the stroller rails 44A and 44B. In particular, strap 22 wraps around stroller rail 44A and is fastened to itself via snap closures 22A (the snap closures are illustrated in FIGS. 1 and 3). Similarly, strap 24 wraps around stroller rail 44B and is fastened to itself via snap closures 24A (the snap closures are illustrated in FIGS. 1 and 3). The top of the removable blanket 20 folds forward to form a flap 20A to expose the child's face.

It should be understood that while some of the fasteners described herein are specifically indicated as either zippers or snap closures, these fasteners may be interchanged with each other or with other types of fasteners (e.g. buttons or hook and loop (i.e., Velcro)) may be substituted without departing from the spirit of the invention.

What is claimed is:

1. A method of converting a sleeping bag attached to a stroller to a blanket attached to the stroller over a child seated therein, comprising:

providing the stroller having a footrest and seating a child in the stroller;

providing the sleeping bag including:

a first blanket defining a front portion of the sleeping bag that converts into a single panel stroller cover, the first blanket having first and second side edges, a top edge and a bottom edge;

a first fastener attached to said first side edge;

a second fastener attached to said second side edge;

a fabric panel attached at said bottom edge of said first blanket and sewn at the side edges of said first blanket so as to form a pouch having a top edge not attached to said first blanket; and a second blanket, separate from the first blanket, defining a back portion of the sleeping bag, the second blanket being removably fastened to the first blanket by the first fastener and second fastener, and removably attached to the stroller;

detaching the second blanket from the stroller;

detaching the second blanket from the first blanket by disengaging the first fastener and the second fastener; and converting the first blanket to the single panel stroller cover by placing the first blanket over the child and attaching the first blanket over the child and to the stroller by inserting the footrest into the pouch.

2. A method in accordance with claim 1, wherein said pouch further comprises a drawstring at the top edge of said pouch, the method further comprising tightening the pouch around the footrest by tensioning the drawstring.

3. A method in accordance with claim 2, wherein the first blanket further comprises a third fastener attached to one of said side edges of said first blanket, the method further comprising fastening the third fastener to the stroller.

4. A method in accordance with claim 3, wherein said third fastener attached to one of said side edges of said first blanket comprises strap and snap closures and is fastened to the stroller by fastening the strap around a rail of the stroller.

5. A method in accordance with claim 1, wherein one of first or second fasteners comprises a tape of zipper teeth.

6. A method in accordance with claim 1, wherein one of said first or second fasteners comprises a hook and loop fastener.

7. A method in accordance with claim 1, wherein said one of said first or second fasteners comprises snap closures.

8. A combination of a stroller and a blanketing device that converts between a sleeping bag attached to the stroller and a single panel stroller cover, comprising:

the stroller, including first and second side rails, a child seat and a footrest;

the blanketing device, including:

an upper blanket that converts into the single panel stroller cover, the upper blanket having first and second side edges, a top edge and a bottom edge;

a first zipper tape attached to said first side edge;

a second zipper tape attached to said second side edge; and a lower blanket separate from the upper blanket;

wherein the device converts between a sleeping bag configuration in which the lower blanket is directly attached to the stroller, positioned between the upper blanket and the stroller, and removably attached to the upper blanket by the first and second zipper tapes, and a single panel stroller cover configuration in which the upper blanket is directly attached to the stroller and the lower blanket is detached from the upper blanket and the stroller; and the upper blanket is attached to the stroller independently of the lower blanket when the device is in the single panel stroller cover configuration, and the lower blanket is independently attached to the stroller when the device is in the sleeping bag configuration.

9. A combination in accordance with claim 8, further comprising a fastener attached to one of said first and second side edges of said upper blanket wherein said fastener couples said first blanket to one of said first and second side rails respectively of said stroller, when the device is in the cover configuration.

10. A combination in accordance with claim 8, wherein the lower blanket comprises at least one opening that receives a portion of at least one of a strap, harness, or seat belt of the stroller to attach the lower blanket to the stroller when the device is in the sleeping bag configuration.

11. A combination in accordance with claim 8, wherein the lower blanket further comprises a top portion opposite the bottom edge, the top portion comprising a hood.

12. A combination in accordance with claim 8, wherein the upper blanket further comprises a fabric panel attached at a bottom edge thereof and attached thereto at the first and second side edges to form a pouch having a top edge not attached to the upper blanket, wherein at least a portion of the footrest is received by the pouch when the device is in the cover configuration.

13. A combination in accordance with claim 12, wherein said pouch further comprises a drawstring at the top edge of said pouch.

14. A method of converting a sleeping bag attached to a stroller to a blanket attached to stroller over a child therein, comprising:

providing a stroller;

providing a sleeping bag attached to the stroller and including:

a first blanket that converts into a single panel stroller cover, the first blanket having first and second side edges, a top edge, and a bottom edge, and defining a front portion of the sleeping bag; and a second blanket, separate from the first blanket, defining a back portion of the sleeping bag, the second blanket being directly removably attached to each of the first blanket and the stroller;

detaching the first blanket from the second blanket, detaching the second blanket from the stroller; and converting the first blanket to the single panel stroller cover by placing the first blanket over the child and directly attaching the first blanket over the child and to the stroller, such that the first blanket extends over the child from the first edge to the second edge of the first blanket, absent any attachment of the second blanket to the stroller.

15. A method in accordance with claim 14, wherein the first blanket further comprises a fastener attached to one of said side edges of said first blanket, the method further comprising fastening the fastener to the stroller.

16. A method in accordance with claim 15, wherein said fastener attached to one of said side edges of said first blanket comprises strap and snap closures and is fastened to the stroller by fastening the strap around a rail of the stroller.

17. A method in accordance with claim 14, wherein the first blanket comprises at least one tape of zipper teeth that removably attach the second blanket to the first blanket and the method further comprises disengaging the zipper teeth to detach the first blanket from the second blanket.

18. A method in accordance with claim 14, wherein the first blanket comprises at least one hook and loop fastener that removably attaches the second blanket to the first blanket and the method further comprising disengaging the at least one hook and loop fastener to detach the first blanket from the second blanket.

19. A method in accordance with claim 14, wherein the first blanket comprises at least one snap closure that removably attaches the second blanket to the first blanket and the method further comprises disengaging the at least one snap closure to detach the first blanket from the second blanket.

20. The method of claim 14, wherein the stroller includes a footrest and the first blanket includes a fabric panel attached at the bottom edge and first and second side edges so as to form a pouch having a top edge not attached to the blanket, the method further comprising inserting the footrest into the pouch to directly attach the first blanket over the child and to the stroller.

* * * * *